United States Patent [19]

Pehler et al.

[11] Patent Number: 4,536,308

[45] Date of Patent: Aug. 20, 1985

[54] LITHIUM SOAP GREASE ADDITIVE

[75] Inventors: Rebecca C. C. Pehler; James R. Whiteman, both of Port Arthur; Arnold C. Witte, Jr., Port Neches, all of Tex.

[73] Assignee: Texaco Inc., White Plains, N.Y.

[21] Appl. No.: 656,286

[22] Filed: Oct. 1, 1984

[51] Int. Cl.[3] ..... C10M 1/48; C10M 1/54

[52] U.S. Cl. ..... 252/32.7 E; 252/41; 252/46.4; 252/49.9

[58] Field of Search ..... 252/41, 32.7 E, 49.9, 252/46.6, 46.4

[56] References Cited

PUBLICATIONS

Smalheer et al., "Lubricant Additives" 1967 Chap. 1.

Boner, "Lubricating Greases" 1954 pp. 450–451.

*Primary Examiner*—Jacqueline V. Howard

*Attorney, Agent, or Firm*—Jack H. Park; Kenneth R. Priem; Richard A. Morgan

[57] ABSTRACT

An experimental grease has been formulated with 8.5 wt % lithium 12-hydroxystearate in a base oil containing an additive composition of a synergistic blend of zinc dialkyldithiophosphates, zinc diamyldithiocarbamate, aromatic amine phosphate, sulfurized sperm oil substitute and the reaction product of coconut oil and diethanolamine.

The lithium 12-hydroxystearate grease has been prepared by a standard kettle procedure. The grease composition exhibits a dropping point in the range expected of a lithium complex grease. The grease keeps its soap fiber structure intact at 390° to 400° F., typical of the melting range of lithium 12-hydroxystearate greases.

The grease is useful for its long life in constant velocity joints.

9 Claims, No Drawings

LITHIUM SOAP GREASE ADDITIVE

BACKGROUND OF THE INVENTION

This invention relates to an additive for lithium 12-hydroxystearate grease.

DESCRIPTION OF THE PRIOR ART

Lithium soap greases have been known and widely used for many years. The principal advantages of a lithium soap grease have included high water resistance and ease of dispersion of the soap in all types of lubricating oil base stocks. The lithium soaps used as thickening agents for those greases are prepared by reaction of lithium hydroxide or other lithium base with conventional high molecular weight fatty acids. Of these, lithium 12-hydroxy stearic acid and the lithium soaps of related hydroxy fatty acids have been particularly useful because of their great mechanical stability.

There are many applications where a high dropping point grease is required. These applications include lubrication of automotive wheel bearings. To achieve a suitable high dropping point, it is shown in the prior art that a lithium complex soap grease is required. These lithium complex greases are compositions of the lithium soaps of combinations of monocarboxylic fatty acids and dicarboxylic fatty acids. These components may be saponified together or separately and then combined, the exact method of saponification and formulation affecting the final properties of these lithium complex greases.

Advances in the grease arts are shown in U.S. Pat. Nos. 3,248,325; 3,390,081; 3,493,507; 3,106,533; and 2,403,067.

SUMMARY OF THE INVENTION

This invention relates to a simple lithium 12-hydroxystearate grease composition containing an additive composition. The grease composition comprises a major portion of a mineral lubricating oil thickened with lithium 12-hydroxystearate and an additive composition. Basis the grease composition, this additive composition consists of 4 to 8 wt % of sulfurized sperm oil substitute, 0.5 to 2.0 wt % of the reaction product of coconut oil and diethanolamine, 2.4 to 5.0 wt % of zinc dialkyldithiophosphate, 0.5 to 2.0 wt % of zinc diamyldithiocarbamate and 0.5 to 1.0 wt % of aromatic amine phosphate.

This simple lithium grease demonstrates a high dropping point which has previously been achieved with lithium complex greases.

DESCRIPTION OF THE PREFERRED EMBODIMENTS

This invention is a grease composition comprising a major portion of a mineral lubricating oil, a grease thickening amount of lithium 12-hydroxystearate and an effective amount of a novel additive composition. Basis the grease composition, this novel additive composition consists essentially of 4 to 8 wt % sulfurized sperm oil substitute, 0.5 to 2.0 wt % preferably 0.5 to 1.0 wt % of the reaction product of coconut oil and diethanolamine, 2.4 to 5.0 wt % of zinc dialkyldithiophosphate, 0.5 to 2.0 wt % preferably 0.5 to 1.0 wt % zinc diamyldithiocarbamate and 0.5 to 1.0 wt % aromatic amine phosphate. This additive composition is a synergistic blend which demonstrates the property of allowing the grease to retain its soap fiber structure intact when heated to a temperature above the melting point of the soap. It is known that lithium 12-hydroxystearate greases become more fluid as the dropping point is approached and it has been necessary to formulate a lithium complex grease for applications requiring a higher dropping point. High dropping point grease is useful in industrial and automotive applications where oil bleed must be avoided.

This lithium 12-hydroxystearate grease has been prepared by a kettle procedure. In a typical procedure, 12-hydroxystearic acid or one of its analogs and excess lithium hydroxide solution is mixed with a refined mineral base oil in a clean, cool kettle. The batch is stirred and heated to 180° F. to 200° F. to dissolve the fat and then held at 180° F. to 200° F. for the saponification reaction which takes about one hour. The batch is then heated to 300° F. to 315° F. to dehydrate the soap fibers formed. Additional base oil is added and the batch heated to 395° F. to 405° F. and held for about 15 minutes to melt the soap. The batch is then quenched by (1) putting cooling oil into the kettle jacket and (2) adding base oil to the batch at a rapid rate to shock cool. The batch temperature after the quench must drop below 375° F. and typically falls within a range of 350° F. to 375° F. Following the quench the grease is cooled to about 325° F. using jacket cooling. At about 325° F., the remaining base oil is added to cool the grease to 180° F. to 200° F. At 180° F. to 200° F. additive is incorporated and the batch is then milled to the desired consistency. The product is smooth, buttery, stringy and has a bland odor.

If the consistency of the product is too hard, it can be corrected with aliquots of additive dissolved in base oil. The aliquots are stirred into the batch for 15 minutes at 180° F. to 200° F. after each correction. In this regard, the invention is an additive composition comprising 40 to 55 wt % sulfurized sperm oil substitute, 6 to 12 wt % of the reaction product of coconut oil and diethanolamine, 25 to 35 wt % of zinc dialkyldithiophosphate, 6 to 12 wt % zinc diamyldithiocarbamate and 6 to 12 wt % aromatic amine phosphate. The additive composition is typically dissolved in a base oil, preferably in an amount of 10 to 13 pounds base oil per pound additive.

Sulfurized sperm oil is a naturally derived mixture of fatty acids which is sulfurized for use as a lubricant additive. It has a Saybolt viscosity of 165 to 235 SUS at 210° F. and kinematic viscosity of 35.1 to 50.3 cp at 210° F. Sulfurized sperm oil has been replaced with a petroleum derived product which is known in the art as sulfurized sperm oil substitute. This substitute has the same properties as the naturally derived oil.

Sulfurized sperm oil substitute participates in the synergistic grease composition demonstrating improved dropping point. It has heretofore been used in the art for its extreme pressure (E.P.) properties. In this regard it is combined with aromatic amine phosphate for extreme pressure properties with more or less of either component added to attain the desired E.P. performance. However, the addition amount is not without limit, as criticality has been found in the 4 to 8 wt % range for sulfurized sperm oil substitute. Below about 4 wt %, E.P. performance drops off. This is thought to be caused by insufficient sulfur in the composition. Above about 8 wt %, corrosion becomes a problem and it is not recommended to exceed this limit. We have formulated greases with 7 wt % sulfurized sperm oil substitute which have not demonstrated corrosion.

Aromatic amine phosphate participates in the synergistic composition in an amount of 0.5 to 1.0 wt %. Additionally, it gives an E.P. boost and is used along with the sulfurized sperm oil substitute to achieve the desired E.P. properties.

In the present invention, coconut oil in an amount of one mole is reacted with 1.8 moles of diethanolamine. The resulting reaction products are substituted N,N-Di(2-Hydroxyethyl)amide, a diester and a monoester. The reaction produces 1.8 moles of the N,N-Di(2-Hydroxyethyl) amide, 0.2 moles of the diester and 0.8 moles of the monoester. Criticality has been found in the amount of this component. An amount of 0.5 wt % in the grease composition is the minimum effective amount and is preferred. Amounts over 1 wt % do not appreciably enhance grease properties. Amounts over 2 wt % are not cost effective.

Zinc dialkyldithiophosphate is a lube oil additive which when used alone is known for E.P. and anti wear properties with 2.4% as the minimum dosage. Dosages above about 5 wt % are not economically effective. The alkyl groups are typically 3 to 7 carbon atoms and may be the same or different. Zinc isobutyl/amyl dithiophosphate and zinc ethyl-isobutyl/isopropyl dithiophosphate are preferred. Hexyl/isopropyl dithiophosphate is more preferred.

Zinc diamyldithiocarbamate is used alone in grease compositions as an antioxident. It is not sufficiently effective in oxidation resistance below about 0.5 wt %. Amounts up to 1 wt % are effective in the synergistic composition, with amounts up to 2.0 wt % effective and economically justified in the synergistic composition.

It has been found experimentally that the grease of the present invention exhibits a unique phase transition in beginning to melt at 380° F., then hardening in consistency as the temperature is raised. Electron micrographs have shown unexpectedly, that this grease keeps its soap fiber structure when heated to 400° F. In contrast, simple lithium 12-hydroxystearate greases melt completely in the 390° F. to 400° F. range. This synergistic effect permits the use of a simple lithium grease where only lithium complex greases had previously been applicable. It was also found that the grease had good anti wear properties.

The amount of lithium 12-hydroxystearate in the grease of the present invention is referred to as a grease thickening amount. This is typically 8 to 25 wt % and in the compositions formulated is 8 to 10 wt %.

This invention is better shown by way of example.

EXAMPLE

A grease was made in a kettle procedure as described herein from the following ingredients:

| | lb. |
|---|---|
| LiOH solution | 8.11 |
| Me 12-hydroxystearate | 8.72 |
| Lubricating oil[a] | 37.64 |
| diethanolamine/coconut oil in oil[b] | 0.50 |
| zinc diamyldithiocarbamate[c] | 0.50 |
| 10 P Pale Oil | 37.64 |
| zinc dialkyldithiophosphate in oil[d] | 2.40 |
| Sulfurized Sperm Oil Substitute | 4.00 |
| Aromatic amine phosphate[e] | 0.50 |
| | 100.00 lb. batch |

[a]SNO 20, solvent refined paraffinic oil.
[b]TLA-626 (reaction product of diethanolamine and coconut oil in a 1.8/1.0 amine/oil mole ratio), TLA-626A is TLA-626 diluted 10 wt % with 100 E Pale Oil (HF). Extreme Pressure Additive -continued

| | lb. |
|---|---|
| Specific gravity 60/60° F. | 0.978 |
| Flash, COC, °F. | 435 |
| Kin Vis, cSt @ 40° C. | 188.8 |
| cSt @ 100° C. | 14.51 |
| TBN (ASTM D 2896) | 32.1 |
| TAN (ASTM D 974) | 5.2 |
| % Nitrogen | 2.9 |

[c]Van lube AZ, antioxidant.
[d]TLA-111B, zinc dialkyldithiophosphate (TLA-111A diluted in 10 P Pale Oil).
[e]Van lube 692, anti wear/EP agent.

The batch was analyzed to be 8.5% soap. Further tests were conducted to compare the experimental grease with an established lithium 12-hydroxystearate grease. The results are reported in Table I. Product 1418(83) is the experimental grease of the present invention. Product 1426(83) is a base grease.

TABLE I

Li 12-OH STEARATE GREASES

| | 1318(81) wt % | 1418(83) wt % | 1426(83) wt % |
|---|---|---|---|
| Composition: | | | |
| LiOH Solution | 8.11 | 8.11 | 8.11 |
| Me 12-OH Stearate | 8.72 | 8.72 | 8.72 |
| Additives: | | | |
| TLA-111A[f] | 2.0 | — | — |
| TLA-111B | — | 2.4 | — |
| Sulf Sperm Oil Subst. | 4.0 | 4.0 | — |
| Vanlube 692 | 0.5 | 0.5 | — |
| Vanlube AZ | — | 0.5 | — |
| Vanlube NA | 0.5 | — | — |
| Diphenylamine | 0.5 | — | — |
| TC-10921[g] | 1.0 | — | — |
| TLA-626A | — | 0.5 | — |
| Base Oils: | | | |
| Solvent refined paraffinic oil (SNO 20) | 41.9 | 42.5 | 41.59 |
| 10 P Pale Oil | 42.9 | 42.5 | 41.59 |
| Total | 100.00 | 100.00 | 100.00 |
| Tests: | | | |
| Dropping Pt., °F. (ASTM D 566) | 341 | 529 | 384 |
| Pen. unwkd. (ASTM D 217) | 321 | 290 | 266 |
| wkd., 60X | 320 | 295 | 270 |
| 10,000 X | 331 | 307 | 312 |
| % change from 60X | 3.4 | 4.1 | 15.6 |
| Timken, OK Load, lb (ASTM D 2509) | 35 | 40 | 20 |
| Score Load, lb | 40 | 45 | 25 |
| LWI/Weld. Point, kg (ASTM D 2596) | 44/250 | 45/250 | 31/160 |
| 4 Ball Wear (ASTM D 2266) 1 hr./RT/1800 rpm/50 Kg., mm. | 0.60 | 0.60 | 1.95 |

[f]Zinc dialkyldithiophosphate (hexyl/isopropy; 11.5% zinc).
[g]N—(2-Hydroxyethyl) tetradecenylsuccinimide, friction modifier.

The elevated dropping point of the experimental grease is noteworthy. In addition to the elevation in dropping point, it has been found that a sample of grease when heated above 400° F. will actually begin to thicken slightly as compared to the conventional grease which will become fluid at temperatures above 400° F. It was also found that the experimental grease upon cooling maintained its grease-like structure, as compared to conventional lithium greases which remain oil-like with little soap structure. Electron micrographs at 8000× magnification were taken of the product of the present invention and lithium 12-hydroxystearate grease 1318(81) from Table I before heating to 400° F. and after heating to above 400° F., followed by cooling to room temperature. The after heating micrograph of the experimental product still showed a characteristic fiber structure.

The principle of the invention and the best mode contemplated for applying that principle have been described. It is to be understood that the foregoing is illustrative only and that other means and techniques can be employed without departing from the true scope of the invention defined in the following claims.

What is claimed is:

1. A grease composition comprising a major portion of a mineral lubricating oil, a grease thickening amount of lithium 12-hydroxystearate and an effective amount of an additive composition, basis the grease composition said additive composition consisting of 4 to 8 wt % sulfurized sperm oil substitute, 0.5 to 2.0 wt % of the reaction product of coconut oil and diethanolamine, 2.4 to 5.0 wt % of zinc dialkyldithiophosphate, 0.5 to 2.0 wt % zinc diamyldithiocarbamate and 0.5 to 1.0 wt % aromatic amine phosphate.

2. The grease composition of claim 1 wherein the lithium 12-hydroxystearate comprises about 8 wt % to about 25 wt % of the grease composition.

3. The grease composition of claim 1 wherein the lithium 12-hydroxystearate comprises about 8 wt % to about 10 wt % of the grease composition.

4. The grease composition of claim 1 wherein the additive composition comprises about 5 wt % to about 10 wt % of the grease composition.

5. The grease composition of claim 1 wherein the reaction product of coconut oil and diethanolamine comprises 0.5 to 1.0 wt %.

6. The grease composition of claim 1 wherein the zinc diamyldithiocarbamate comprises 0.5 to 1.0 wt %.

7. The grease composition of claim 1 wherein the sulfurized sperm oil substitute is in an amount of 4 to 8 wt %; the reaction product of coconut oil and diethanol amine is in an amount of 0.5 to 1.0 wt %; the zinc dialkyldithiophosphate is in an amount of 2.4 to 5.0 wt %; the zinc diamyldithiocarbamate is in an amount of 0.5 to 1.0 wt % and the aromatic amine phosphate is in an amount of 0.5 to 1.0 wt %.

8. A grease additive composition comprising 40 to 55 wt % sulfurized sperm oil substitute, 6 to 12 wt % of the reaction product of coconut oil and diethanolamine, 25 to 35 wt % of zinc dialkyldithiophosphate, 6 to 12 wt % zinc diamyldithiocarbamate and 6 to 12 wt % aromatic amine phosphate.

9. The additive composition of claim 8 which is dissolved in a lubricating oil in an amount of 10 to 13 pounds lubricating oil per pound of additive.

* * * * *